United States Patent [19]

Bubliewicz

[11] Patent Number: 4,841,283

[45] Date of Patent: Jun. 20, 1989

[54] SECURITY HINGE UTILIZING CONCEALED RADIATIVE SENSING TO DETECT HINGE POSITION

[75] Inventor: Leszek Bubliewicz, San Antonio, Tex.

[73] Assignee: Southern Steel Company, San Antonio, Tex.

[21] Appl. No.: 136,091

[22] Filed: Dec. 21, 1987

[51] Int. Cl.[4] ..... G08B 13/08; G08B 13/18

[52] U.S. Cl. ..... 340/545; 200/61.7; 200/61.93; 250/222.1; 250/224; 307/116; 307/117; 340/549; 340/556; 340/600; 340/686

[58] Field of Search ..... 340/545, 600, 686, 556, 340/557, 549; 200/61.7, 61.93; 307/117, 116; 250/222.1, 224; 116/85, 86

[56] References Cited

U.S. PATENT DOCUMENTS

| | | | |
|---|---|---|---|
| Re. 30,716 | 8/1981 | Suska | 200/61.7 |
| 499,428 | 6/1893 | Hull | 200/61.7 |
| 3,772,669 | 11/1973 | Johnston et al. | 340/545 |
| 3,838,234 | 9/1974 | Peterson | 200/61.7 |
| 3,896,404 | 7/1975 | Peterson | 200/61.7 |
| 4,016,381 | 4/1977 | Rodseth | 200/61.7 |
| 4,049,934 | 9/1977 | Newlon | 200/61.7 |
| 4,062,314 | 12/1977 | Allen et al. | 116/85 |
| 4,168,409 | 9/1979 | McNinch | 200/61.7 |
| 4,211,990 | 7/1980 | Gwozdz | 200/61.7 |
| 4,284,861 | 8/1981 | Senften | 200/61.7 |
| 4,394,584 | 7/1983 | Spahni et al. | 200/61.32 |
| 4,507,654 | 3/1985 | Stolarczyk et al. | 340/545 |
| 4,583,082 | 4/1986 | Naylor | 340/545 |
| 4,629,883 | 12/1986 | Geiger | 340/556 |

*Primary Examiner*—Glen R. Swann, III

[57] ABSTRACT

A hinge construction having radiative emitter and detector concealed within the body of the hinge's knuckles so as to be in communication with each other when the hinge leaves, and therefore the door, are in a closed position. This communication is permitted through an opening in a notched collar which is juxtaposed between the emitter and detector elements, the notch being aligned with the emitter and detector when the hinge is closed. The opening of the hinge leaves rotates the collar to misalign the collar notch with the emitter and detector elements, thereby causing an electronics circuit module to form a change of state signal which may then be reported to an external monitoring or alarm system. Closing the hinge leaves to realign the notch with the emitter and detector elements will result in the sensing means being reset.

12 Claims, 3 Drawing Sheets

SECURITY HINGE UTILIZING CONCEALED RADIATIVE SENSING TO DETECT HINGE POSITION

BACKGROUND OF THE INVENTION

Field of Invention

The present invention relates generally to hinge constructions, and more particularly to a security hinge construction including a concealed radiative emitter and detector for detecting hinge leaf movement. The hinge construction may be included in an external alarm or monitor system which monitors the relative position of the hinge, i.e., whether the hinge is opened or closed.

General Background

Monitoring the state of a door is desirable in a variety of situations such as fire control, environmental control, and prisons or other security systems, to name a few. Specifically, in the case of security systems, there are two primary objectives in monitoring any portal of ingress or egress. First, the monitoring system must be reliable and tamper-proof. Second, the monitoring system should be concealed from observation of would be intruders or confined persons to prevent sabotage. In the past, door monitoring has generally been accomplished through the sensing of a change in position of some part of the door assembly, e.g., the door relative to the door jamb; or, the rotation of the door relative to some fixed point.

To accomplish these objectives, prior monitoring systems have utilized a variety of different sensing means to detect the state of the door. Such prior sensing systems have included electro-mechanical means, such as a simple contact switch mounted on the hinge leaves as disclosed in U.S. Pat. No. 499,428 or a series of rotating contacts concealed in the hinge as disclosed in U.S. Pat. No. 3,838,234. Other systems have included electro-magnetic switches such as disclosed in U.S. Pat. No. 4,062,314 and more complicated electro-mechanical switches, as disclosed in U.S. Pat. No. 4,016,381. To protect against tampering or sabotage, electro-mechanical switches have been concealed in the hinge body. This method of concealment was disclosed in several U.S. patents, including U.S. Pat. No. 4,049,934; U.S. Pat. No. 4,168,409; and U.S. Pat. No. 30,716.

Non-mechanical means of sensing having also been used in a number of different security systems. A magnetic flux detection system was disclosed in U.S. Pat. No. 3,772,669, which operated in combination with a mechanical means for moving a magnetic pole piece. Radiative emitter and detector systems were disclosed in U.S. Pat. No. 4,394,584; U.S. Pat. No. 4,583,082; U.S. Pat. No. 4,507,654; and U.S. Pat. No. 4,629,883.

Each of these prior non-mechanical monitoring systems fail to meet one of the objectives in a security situation as they are not concealed. These systems invited tampering which resulted in false indications from the sensing means or system failure. Electro-mechanical sensing systems have a number of disadvantages in that they are subject to wear and, in many cases, sabotage, tampering or false readings.

In contrast to these prior systems, the present invention eliminates the disadvantages inherent in electro-mechanical systems through the use of a concealed non-mechanical sensing means. The present invention also provides an inexpensive, simple system which is easy to install and requires a minimum of special construction or adaptation.

SUMMARY OF THE INVENTION

Briefly, the present invention provides a new and improved security hinge construction which includes a first and second pivotally connected hinge leaf, each leaf having at least one hinge knuckle disposed adjacent to and pivotally connected to a hinge knuckle associated with the other leaf. The first leaf of the hinge includes a concealed pocket formed within the knuckle of the first leaf for the containment of an electronic circuit module; the circuit module includes circuitry for signal conditioning, voltage regulation, output relay and a radiative emitter and detector means. The emitter and detector are mounted in opposing positions on the module in a manner to permit the insertion of an object between them to interrupt the transmission and reception of radiative signals between them. The second leaf of the hinge has one or more knuckles which are aligned and pivotally connected to the first leaf of the hinge. An actuator pin is located within the knuckle of the second leaf adjacent to the knuckle of the first leaf containing the circuit module; the pin being designed to pivot with the second leaf of the hinge and including a notched collar which is juxtaposed between the radiative emitter and detector means, permitting communication between the emitter and detector only when the hinge leaves are closed. An interruption of communication between the emitter and detector causes the circuit module to form a change-of-position signal which is relayed by means of wire or fiber optic conductors to an external monitoring or alarm system. The actuator pin is reset via the interaction of a cam on the actuator pin with a stop located within the knuckle of the first leaf of the hinge, thereby limiting rotational movement of the actuator pin to less than 200°, resulting in the system being reset when the hinged leaves are closed, aligning the collar notch with the emitter and detector.

DETAILED DESCRIPTION

Figure 1:
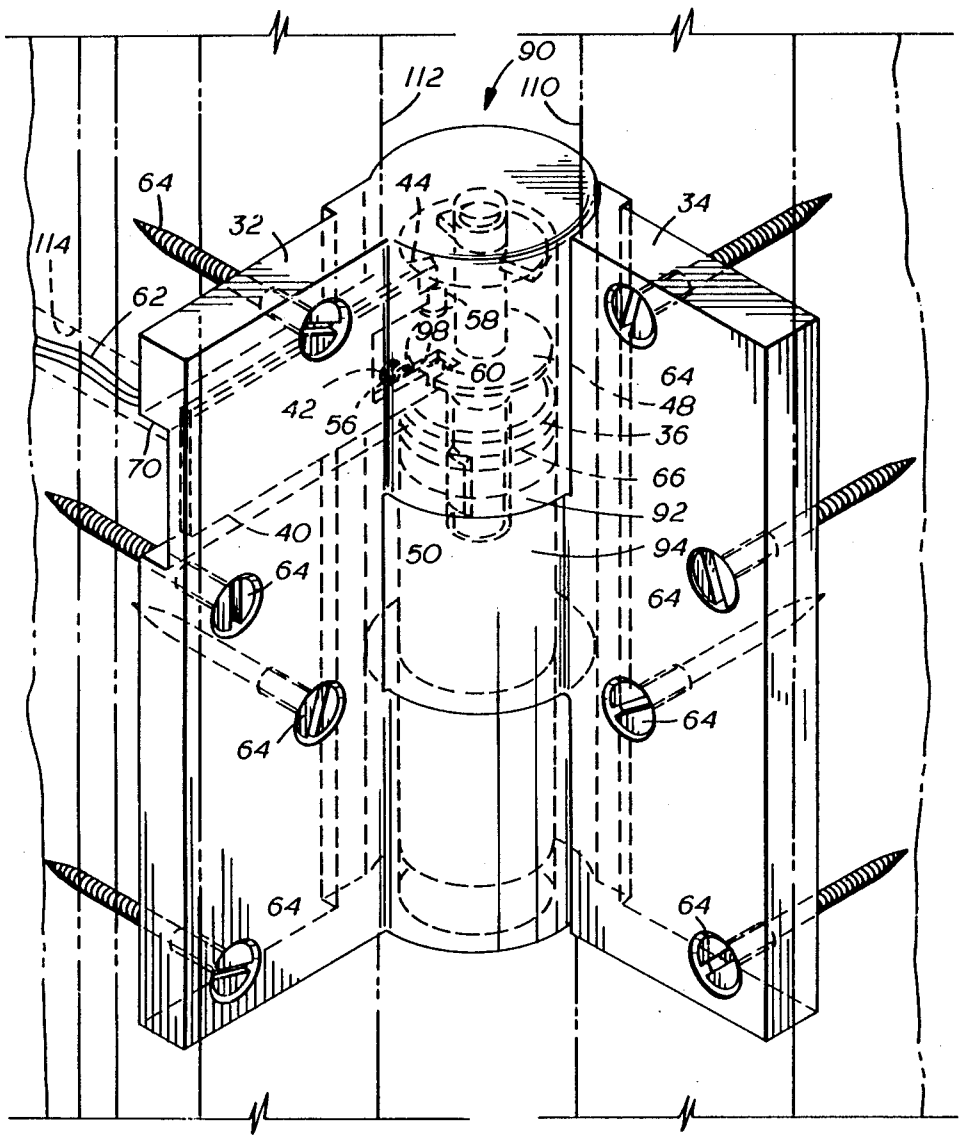
FIG. 1 is a perspective view of the invention set into a door and door frame depicting the hidden workings of the hinge in phantom.

In the drawings and in the discussion which follows, like numerals and letters refer to like parts where they occur. Referring now to FIG. 1, an assembled hinge 90 is installed into door 110 and door frame 112 by means of screws 64. The hinge 90 includes a first hinge leaf 32 and a second hinge leaf 34. Leaves 32 and 34 each include at least one hinge knuckle, knuckles 92 and 94, respectively, the knuckles 92, 94 being adjacent, aligned and pivotally connected. The first hinge leaf 32 includes a pocket 70 which extends into the first hinge leaf knuckle 92. Pocket 70 is adapted to receive an electronic circuit module 40. A circuit module 40 is mounted hidden from view in all door positions and is connected to an external electrical circuit via conductors 62 which pass through a door frame 112 via a drilled conduit 114. A radiative emitter 60 and detector 58 (for example, an infrared emitter and detector or a light emitter and photoelectric detector) are contained within the first hinge leaf knuckle 92 and oriented substantially parallel to the rotational or pivotal axis of first hinge leaf knuckle 31 and second hinge leaf knuckle 94. A cam stop 44 is formed on the inner circumference of the first hinge leaf knuckle 92. The second leaf 34 is shown installed in door 110 using screws 64. The second hinge leaf knuckle 94 is located adjacent to, and aligned with the door frame hinge knuckle 92, which contains circuit module 40. A pivot pin 36 is press-fit into second hinge leaf knuckle 94 coaxially with the pivotal axis of hinge 90. Pin 36 is retained by the insertion of a set screw 42 through a drilled and tapped hole 56 in second hinge leaf knuckle 94 which comes into contact with detent ring 66. The pivot pin 36 includes a coaxial blind hole 54 therein. An actuator pin 96 is mounted in the pivot pin 36 such that an actuator collar 48 is juxtaposed between the radiative emitter 60 and detector 58 elements contained within first hinge leaf knuckle 92. In FIG. 1, a collar notch 98 and emitter 60 and detector 58 are misaligned, thereby preventing detector 58 from receiving signals transmitted by the emitter 60. When the door 110 is closed, hinge leaves 32 and 34 are closed as well, thereby aligning collar notch 98 with the emitter 60 and detector 58 permitting reception of radiative transmission.

Figure 2:
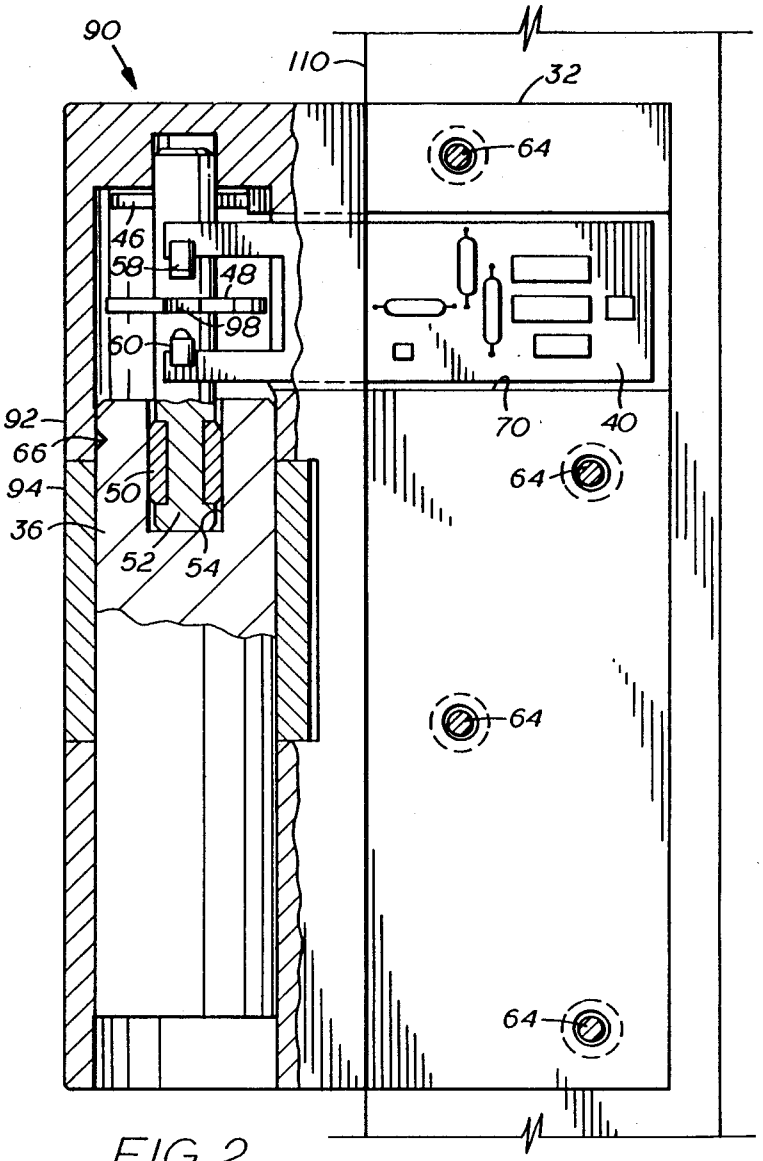
FIG. 2 is a partial sectional view of the hinge in a closed position.

Referring now to FIG. 2, hinge 90 is illustrated in partial section in a closed position disclosing circuit module 40 and the alignment of the emitter means 60 and detector means 58 with the pivotal axis of hinge knuckles 92 and 94. A nylon insert 50 is installed in the actuator pin 96 to provide a close fit between the actuator pin cylinder 52 and the blind hole 54 in pivot pin 36, thereby preventing inadvertent rotation of the actuator pin 96. The actuator collar 48 and collar notch 98 are aligned between emitter 60 and detector 58 thereby permitting signal communication. Actuator cam 46 is shown in relation to cam stop 44 in hinge knuckle 92. Drilled and countersunk holes 64 in hinge leaves 32 and 34 are provided to facilitate securing installation of the hinge assembly 90.

Figure 3:
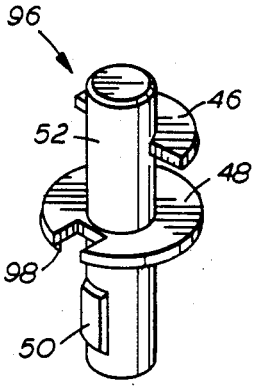
FIG. 3 is an elevated view of the actuator pin.

In FIG. 3 nylon insert 50 is shown inserted in cylindrical body 52 of the actuator pin 96. An actuator collar 48 is mounted on the cylindrical pin 52 and is radially disposed, perpendicular to the longitudinal axis of pin 52. Collar notch 98 is radially disposed on actuator collar 48. An actuator cam 46, shaped to limit the rotation of the actuator 96 to less than 200° is affixed to the actuator pin 52 and radially disposed perpendicular to the longitudinal axis of the pin 52.

Figure 4:
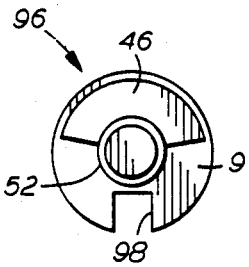
FIG. 4 is a top view of the actuator pin showing the actuator cam and collar.
Figure 7:
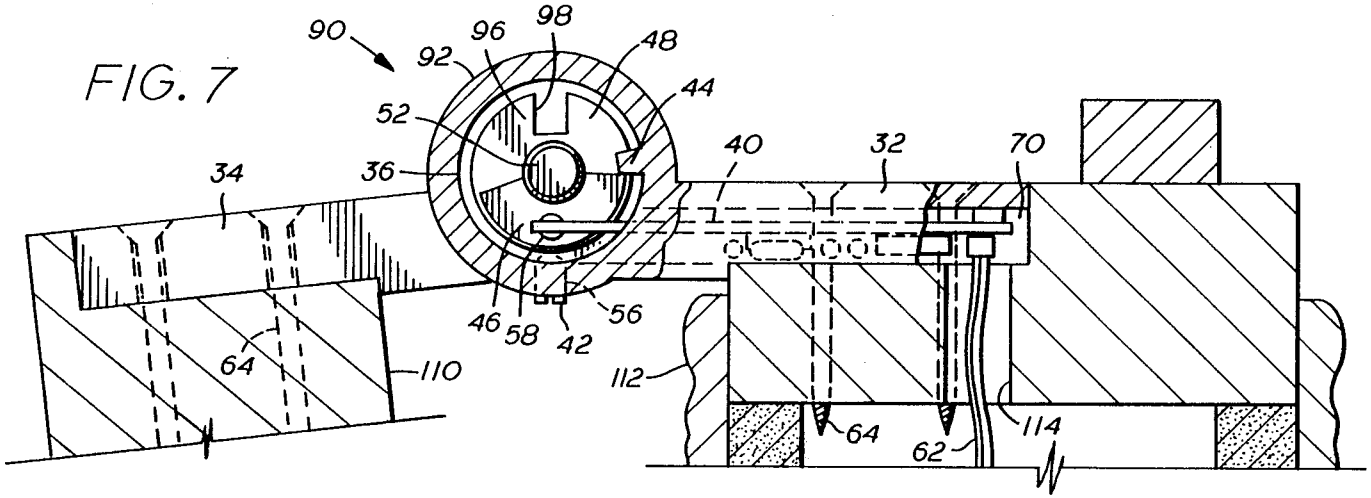
FIG. 7 is a top partial sectional view of the hinge in an open position.

Referring now to FIG. 4, actuator pin 96 includes the actuator collar 48, the actuator cam 46 and the collar notch 98 in the actuator collar which permits communication of the radiant signals between emitter means 60 and detector means 58 as shown in FIGS. 1, 2, and 7. A hidden view is shown of the nylon insert 50 which is placed in the actuator pin 52.

Figure 5:
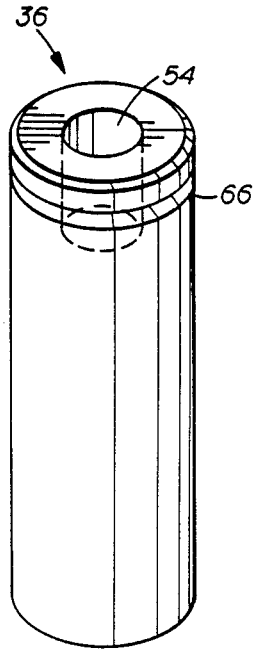
FIG. 5 is an elevated view of the pivot pin, showing the hidden blind hole and detent ring.

FIG. 5 is an elevated view of the pivot pin 36, showing its cylindrical shape and a blind hole 54 drilled coaxially with the longitudinal axis of the pivot pin 36. A detent ring 66 is shown as being circumferentially disposed on the pivot pin 36. Said detent ring 66 provides a locating point for pivot pin 36, when placed in hinge knuckle 34 and in contact with set screw 56, as shown in FIG. 1.

Figure 6:
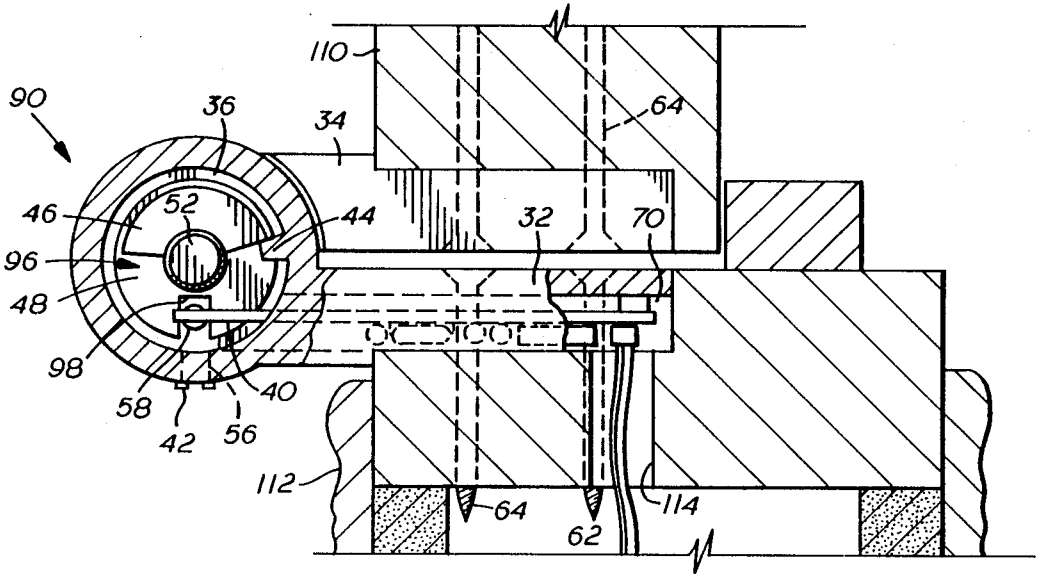
FIG. 6 is a top partial sectional view of the hinge in the closed position.

FIG. 6 is a top partial sectional view of the closed hinge assembly 90 showing the actuator cam 46 in contact with the cam stop 44 and the actuator collar notch 98 aligned with radiant emitter 60 and detector 58 elements.

FIG. 7 is a top partial cross-sectional view similar to FIG. 6 depicting the hinge 90 in an open position. Actuator cam 46 is in contact with the stop 44 preventing any further rotation of the actuator 96, with notch 98 being misaligned with the radiant emitter 60 and detector 58. This misalignment would indicate open state to an external system.

Figure 8:
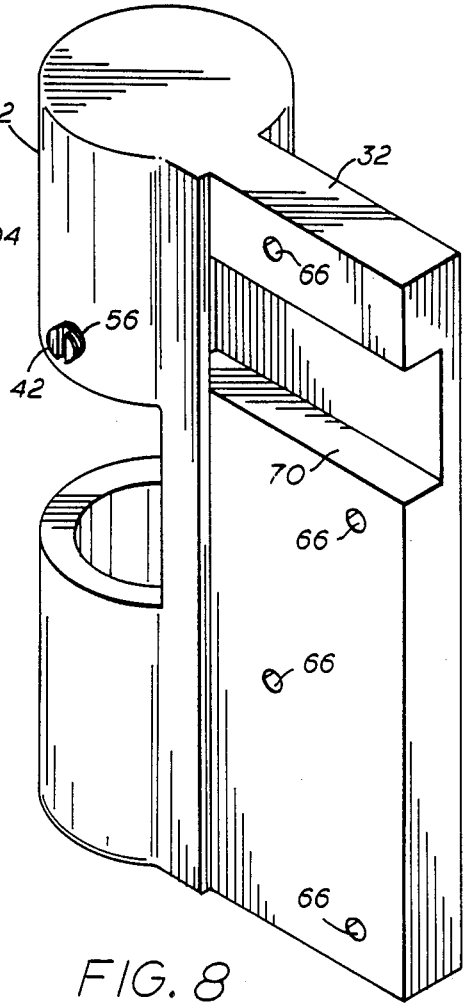
FIG. 8 is an elevated view of hinge leaf 1 showing the cam stop and pocket.

FIG. 8 depicts a partial view of the door frame hinge 32, showing the circuit module pocket 70 which extends into the hinge knuckle 92. The cam stop 44 is shown as being located on the inner circumference of the hinge knuckle 92.

Figure 9:
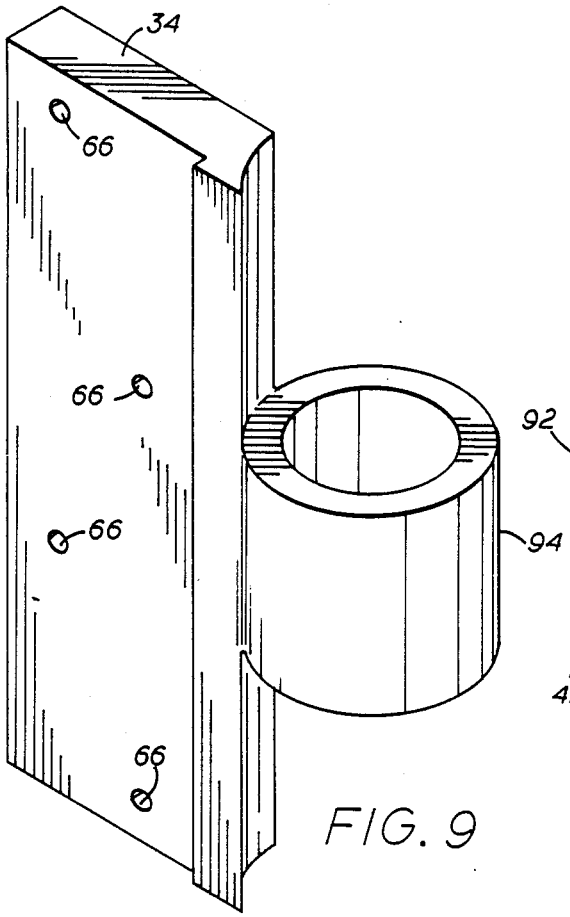
FIG. 9 is an elevated view of hinge leaf 2 showing a drilled and tapped hole.

FIG. 9 illustrates hinge knuckle 94 of hinge leaf 34 depicting the drilled and tapped hole 56 for retention of the pivot pin 36.

Figure 10:
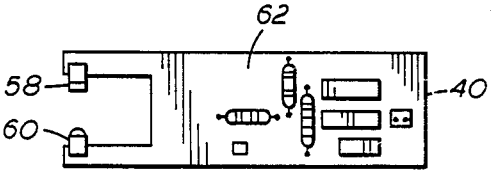
FIG. 10 is a front view of the circuits module, depicting the location and mounting of the emitter and detector elements.

FIG. 10 is a front view of the circuit module 40 depicting conductors 62 by which the circuit module 40 may be connected into an external electrical circuit. The emitter element 60 and the detector element 58 are shown as mounted on the circuit module facing each other separated by a gap to permit the interposition of the actuator collar 48, as shown in FIG. 1, to prevent reception of the transmitted signals.

The invention embodied in the hinge construction above is useful in the monitoring of the status of a door (open or closed). The benefit of this construction is that it utilizes a non-mechanical means of sensing and is concealed from external view or tampering.

In operation, hinge 90 is installed into a door 110 and door frame 112. Opening door 110 causes hinge knuckle 94 to rotate relative to hinge knuckle 92. Pivot pin 36 and actuator 96 rotate with knuckle 94, thereby causing actuator collar notch 98 to misalign relative to emitter 60 and detector 58, causing circuit module 40 to form a signal which will indicate an open state. This information is passed on to external systems via conductor 62. The hinge 90 may be reset by opening the door 110 in excess of 200°. The actuator cam 46 comes into contact with stop 44, causing the actuator 96 to rotate within pivot pin 36. When door 110 is closed, the notch 98 is realigned with emitter 60 and detector 58.

Although different embodiments of the invention may vary in detail, they are still intended to be within the scope of the inventive concept described above. The details described in the foregoing preferred embodiments are intended be illustrative and not limiting in any sense.

I claim:

1. A hinge construction for mounting a door to a door frame or the like and providing for detection of changes in hinge leaf position, comprising:

(a) a hinge having a first and a second leaf, each leaf having a leaf body and at least one knuckle, said hinge knuckles being adjacent to each other and pivotally connected, thereby defining a hinge pivotal axis, each leaf being moveable relative to the other; said first leaf including a pocket formed in said leaf body and extending into said knuckle;

(b) a radiative sensing means, including a radiative emitter means and radiative detector means mounted and concealed within said pocket and knuckle of said first hinge leaf, said sensing means being adapted to provide a change-of-position signal in response to an actuating means and adapted for connection to external electrical circuits;

(c) an actuating means mounted and concealed within said second hinge leaf knuckle to rotate with the rotation of said second hinge leaf, said actuating means extending into said first hinge leaf knuckle, the rotation of said actuating means shielding said radiative detector means from said radiative emitter means when said hinge is opened, thereby causing said radiative sensing means to form a change-of-position signal indicative of an open-hinge position; and (d) a means for resetting said actuator means.

2. The hinge construction of claim 1, wherein said first hinge leaf further includes a stop means for limiting rotation of said actuating means.

3. The hinge construction of claim 2, wherein said radiative sensing means includes an electronic circuit module mounted within said first hinge leaf pocket and adapted to receive a change-of-position signal from said detector means and provide an output signal suitable for use with an external monitoring system.

4. The hinge construction of claim 3, wherein said radiative emitter and detector means are mounted on said circuit module opposing each other and extend into said first hinge leaf knuckle in a manner to permit said actuator means to be interposed between said emitter and detector means.

5. The hinge construction of claim 4, wherein said radiative emitter and detector means include an infrared emitting diode and an infrared detector.

6. The hinge construction of claim 4, wherein said radiative emitter and detector means include a light emitting diode and a photo-electric detector.

7. The hinge construction of claim 4, wherein the method of mounting said actuator means includes a cylindrical pivot pin having a first face with a blind hole therein to receive said actuating means, said pivot pin being pressed into said second hinge knuckle with said pivot pin first face being adjacent to said first hinge leaf knuckle, and a means for securing said pivot pin in said second hinge leaf knuckle.

8. The hinge construction of claim 7, wherein said means for securing said pivot pin includes a detent ring located circumferentially around said pivot pin, said second hinge leaf knuckle having a drilled and tapped hole therein oriented radially to said hinge pivot axis, and a set screw inserted in said second hinge leaf knuckle, said set screw coming in contact with said detent ring thereby locating and retaining said pivot pin within said knuckle.

9. The hinge construction of claim 8, wherein said actuator means includes a rotating actuator pin comprising:

(a) a cylindrical pin, adapted to fit closely within said pivot pin blind hole;

(b) a radially disposed actuator collar affixed to said cylindrical pin, said collar having a passageway therethrough to permit communication between said radiative emitter and detector means;

(c) a radially disposed cam affixed to said pin; said actuator pin being mounted in said pivot pin blind hole and extending into said first hinge leaf knuckle, said collar being interposed between said radiative emitter and detector means permitting said radiative emitter and detector to be in communication with each other through said actuator collar passageway when said hinge is in a closed position; the rotation of said actuator pin being limited when said radially disposed cam comes into contact with said stop means.

10. The hinge construction of claim 9, wherein said stop means includes a mechanical stop disposed around the inner circumference of said first hinge leaf knuckle.

11. The hinge construction of claim 10, wherein said actuator pin further includes a nylon insert mounted on the circumference of said actuator pin thereby creating an interference fit between said actuator pin and said pivot pin, preventing inadvertent rotation of said actuator pin.

12. The hinge construction of claim 11, wherein said means of resetting said actuator means includes opening said hinge leaves in excess of 200°, thereby bringing said actuator means cam into contact with said stop means causing said actuator pin to rotate within said pivot pin, and returning said leaves to a closed position, thereby aligning said actuator collar passageway with said radiative emitter and detector means.

* * * * *